US010578050B2

(12) United States Patent
Lineton et al.

(10) Patent No.: US 10,578,050 B2
(45) Date of Patent: Mar. 3, 2020

(54) THERMALLY INSULATED STEEL PISTON CROWN AND METHOD OF MAKING USING A CERAMIC COATING

(71) Applicant: FEDERAL-MOGUL CORPORATION, Southfield, MI (US)

(72) Inventors: Warran Boyd Lineton, Chelsea, MI (US); Miguel Azevedo, Ann Arbor, MI (US); Greg Salenbien, Britton, MI (US)

(73) Assignee: Tenneco Inc., Lake Forest, IL (US)

( * ) Notice: Subject to any disclaimer, the term of this patent is extended or adjusted under 35 U.S.C. 154(b) by 264 days.

(21) Appl. No.: 15/354,001

(22) Filed: Nov. 17, 2016

(65) Prior Publication Data

US 2017/0145952 A1 May 25, 2017

Related U.S. Application Data

(60) Provisional application No. 62/257,993, filed on Nov. 20, 2015.

(51) Int. Cl.
*F02F 3/14* (2006.01)
*F02F 3/26* (2006.01)
(Continued)

(52) U.S. Cl.
CPC ..... *F02F 3/14* (2013.01); *C23C 4/02* (2013.01); *C23C 4/06* (2013.01); *C23C 4/073* (2016.01);
(Continued)

(58) Field of Classification Search
CPC ..... F02F 3/14
See application file for complete search history.

(56) References Cited

U.S. PATENT DOCUMENTS 1,391,106 A 9/1921 Guibert
1,462,654 A 7/1923 Philip
(Continued)

FOREIGN PATENT DOCUMENTS

CA 2159232 A1 3/1996
CA 2440804 A1 3/2005
(Continued)

OTHER PUBLICATIONS

International Search Report, dated Feb. 8, 2017 (PCT/US2016/062649).

(Continued)

*Primary Examiner* — F Daniel Lopez
(74) *Attorney, Agent, or Firm* — Robert L. Stearns; Dickinson Wright, PLLC

(57) ABSTRACT

A piston for a diesel engine is provided. The piston includes a thermal barrier coating applied to a crown formed of steel. A layer of a metal bond material is first applied to a combustion surface of the crown, followed by a gradient structure including a mixture of the metal bond material and a ceramic material, followed by a layer of the ceramic material. The ceramic material includes at least one of ceria, ceria stabilized zirconia, yttria stabilized zirconia, calcia stabilized zirconia, magnesia stabilized zirconia, and zirconia stabilized by another oxide. The thermal barrier coating is applied by a thermal spray process or HVOF. The thermal barrier coating has a porosity of 2% by vol. to 25% vol., based on the total volume of the thermal barrier coating, a thickness of less than 1 mm, and a thermal conductivity of less than 1.00 W/m·K.

16 Claims, 6 Drawing Sheets

EXAMPLE 1:
50wt% ceramic/25wt% mix/25wt% bond consisting of CSZ/CSZ+bond/bond

| Layer | Component | % by mass |
|---|---|---|
| Top | CSZ | 50.0 |
| | YSZ | 0.0 |
| Mid | CSZ | 12.5 |
| | YSZ | 0.0 |
| | Bond | 12.5 |
| Bond | Bond only | 25.0 |

(51) Int. Cl.

| | |
|---|---|
| ***F02F 3/00*** | (2006.01) |
| ***C23C 4/126*** | (2016.01) |
| ***C23C 4/11*** | (2016.01) |
| ***C23C 4/12*** | (2016.01) |
| ***C23C 4/02*** | (2006.01) |
| ***C23C 4/06*** | (2016.01) |
| ***C23C 4/073*** | (2016.01) |
| ***C23C 28/00*** | (2006.01) |
| ***C23C 4/10*** | (2016.01) |
| ***C23C 4/18*** | (2006.01) |

(52) U.S. Cl.

CPC ..... *C23C 4/10* (2013.01); *C23C 4/11* (2016.01); *C23C 4/12* (2013.01); *C23C 4/126* (2016.01); *C23C 4/18* (2013.01); *C23C 28/321* (2013.01); *C23C 28/3215* (2013.01); *C23C 28/3455* (2013.01); *C23C 28/36* (2013.01); *F02F 3/0084* (2013.01); *F02F 3/26* (2013.01)

(56) References Cited

U.S. PATENT DOCUMENTS

| | | | |
|---|---|---|---|
| 1,508,099 | A | 9/1924 | Hawley, Jr. |
| 1,559,439 | A | 10/1925 | Kapraun |
| 1,605,838 | A | 11/1926 | Hawley, Jr. |
| 1,869,077 | A | 7/1932 | Prentice |
| 2,600,440 | A | 6/1952 | Smith |
| 2,926,649 | A | 3/1960 | Hicks |
| 3,552,370 | A | 1/1971 | Briggs |
| 3,820,523 | A | 6/1974 | Showalter et al. |
| 3,911,891 | A | 10/1975 | Dowell |
| 3,976,809 | A | 8/1976 | Dowell |
| 4,074,671 | A | 2/1978 | Pennila |
| 4,138,984 | A | 2/1979 | Steidle et al. |
| 4,471,017 | A | 9/1984 | Poeschel et al. |
| 4,645,440 | A | 2/1987 | Murata et al. |
| 4,645,716 | A | 2/1987 | Harrington et al. |
| 4,694,813 | A | 9/1987 | Mielke |
| 4,711,208 | A | 12/1987 | Sander et al. |
| 4,719,089 | A | 1/1988 | Gardner |
| 4,738,227 | A | 4/1988 | Kamo et al. |
| 4,742,030 | A | 5/1988 | Masaki et al. |
| 4,770,133 | A | 9/1988 | Schibalsky |
| 4,811,701 | A | 3/1989 | Buhl et al. |
| 4,852,542 | A | 8/1989 | Kamo et al. |
| 4,891,343 | A | 1/1990 | Quadair |
| 4,977,114 | A | 12/1990 | Horinouchi et al. |
| 4,980,321 | A | 12/1990 | Tsujimura |
| 5,014,605 | A | 5/1991 | Santi |
| 5,058,488 | A | 10/1991 | Cullen et al. |
| 5,169,674 | A | 12/1992 | Miller |
| 5,175,132 | A | 12/1992 | Ketcham |
| 5,236,787 | A | 8/1993 | Grassi |
| 5,240,741 | A | 8/1993 | Edwards, III et al. |
| 5,305,726 | A | 4/1994 | Scharman et al. |
| 5,320,909 | A | 6/1994 | Scharman et al. |
| 5,384,200 | A | 1/1995 | Giles et al. |
| 5,477,820 | A | 12/1995 | Rao |
| 5,658,837 | A | 8/1997 | Quadair |
| 5,705,231 | A | 1/1998 | Nissley et al. |
| 5,713,324 | A | 2/1998 | Frame et al. |
| 5,722,379 | A | 3/1998 | Binder et al. |
| 5,805,973 | A | 9/1998 | Coffinberry et al. |
| 5,900,283 | A | 5/1999 | Vakil et al. |
| 5,985,368 | A | 11/1999 | Sangeeta et al. |
| 5,987,882 | A | 11/1999 | Voss et al. |
| 6,145,763 | A | 11/2000 | Fleming et al. |
| 6,337,459 | B1 | 1/2002 | Terwijn et al. |
| 6,606,983 | B2 | 8/2003 | Bedwell et al. |
| 6,656,600 | B2 | 12/2003 | Strangman et al. |
| 6,723,674 | B2 | 4/2004 | Wang et al. |
| 6,877,473 | B2 | 4/2005 | Bischofberger et al. |
| 6,886,548 | B2 | 5/2005 | Suck et al. |
| 7,383,806 | B2 | 6/2008 | Abi-Akar et al. |
| 7,383,807 | B2 | 6/2008 | Azevedo et al. |
| 7,458,358 | B2 | 12/2008 | Lineton et al. |
| 7,556,840 | B2 | 7/2009 | Altin |
| 7,566,472 | B2 | 7/2009 | Coudurier |
| 7,793,631 | B2 | 9/2010 | Niwa |
| 7,859,100 | B2 | 12/2010 | Torigoe et al. |
| 8,053,089 | B2 | 11/2011 | Margolies et al. |
| 8,272,843 | B1 | 9/2012 | Ryznic et al. |
| 8,505,513 | B2 | 8/2013 | Kashdan |
| 8,535,779 | B1 | 9/2013 | Smith et al. |
| 8,574,704 | B2 | 11/2013 | Smith et al. |
| 8,863,720 | B2 | 10/2014 | Lineton |
| 8,925,534 | B2 | 1/2015 | Bachmann et al. |
| 9,115,659 | B2 | 8/2015 | Lorenz et al. |
| 9,163,579 | B2 | 10/2015 | Aharonov et al. |
| 9,194,280 | B2 | 11/2015 | Berkemeier et al. |
| 2003/0084858 | A1 | 5/2003 | Kracklauer |
| 2003/0196547 | A1 | 10/2003 | Bischofberger et al. |
| 2005/0056007 | A1 | 3/2005 | Bourgon |
| 2006/0219598 | A1 | 10/2006 | Cody et al. |
| 2007/0000468 | A1 | 1/2007 | Azevedo et al. |
| 2007/0113802 | A1 | 5/2007 | Mihara |
| 2008/0072790 | A1 | 3/2008 | Ma et al. |
| 2008/0073063 | A1 | 3/2008 | Clavenna et al. |
| 2008/0131608 | A1 | 6/2008 | Torigoe et al. |
| 2008/0167403 | A1 | 7/2008 | Burkle |
| 2008/0311306 | A1 | 12/2008 | Xiao et al. |
| 2009/0162670 | A1 | 6/2009 | Lau et al. |
| 2009/0307967 | A1 | 12/2009 | Gardener et al. |
| 2010/0081569 | A1 | 4/2010 | Sepeur et al. |
| 2011/0048017 | A1 | 3/2011 | Margolies et al. |
| 2012/0048227 | A1 | 3/2012 | Tricoire |
| 2013/0025561 | A1 | 1/2013 | Gabriel et al. |
| 2013/0133609 | A1 | 5/2013 | Matsuo |
| 2013/0244025 | A1 | 9/2013 | Smith et al. |
| 2013/0298531 | A1 | 11/2013 | Yokoyama |
| 2014/0251255 | A1 | 9/2014 | Beerens et al. |
| 2014/0326224 | A1 | 11/2014 | Malfa et al. |
| 2015/0017044 | A1 | 1/2015 | Steinwandel et al. |
| 2015/0064376 | A1 | 3/2015 | Smith et al. |
| 2015/0104626 | A1 | 4/2015 | Tomita et al. |
| 2015/0114373 | A1 | 4/2015 | Beasley |
| 2016/0047284 | A1 | 2/2016 | Turgeon et al. |
| 2017/0121839 | A1* | 5/2017 | Yamashita ..... F02F 3/14 |
| 2017/0145914 | A1 | 5/2017 | Lineton et al. |
| 2017/0241371 | A1 | 8/2017 | Schneider |
| 2017/0268457 | A1 | 9/2017 | Azevedo et al. |

FOREIGN PATENT DOCUMENTS

| | | | |
|---|---|---|---|
| CA | 2576004 | A1 | 9/2007 |
| CA | 2529781 | C | 10/2010 |
| CN | 202531299 | U | 11/2012 |
| DE | 3038235 | A1 | 5/1982 |
| DE | 3346969 | A1 | 7/1985 |
| DE | 10029810 | A1 | 12/2001 |
| DE | 10108834 | A1 | 9/2002 |
| DE | 102007016946 | A1 | 10/2008 |
| DE | 2007026746 | A1 | 12/2008 |
| DE | 202011107284 | U1 | 1/2012 |
| DE | 102012216929 | A1 | 3/2014 |
| EP | 0093486 | A1 | 11/1983 |
| EP | 0282490 | A4 | 12/1988 |
| EP | 0816528 | A1 | 1/1998 |
| EP | 0874066 | B1 | 8/2002 |
| EP | 1674663 | A2 | 6/2006 |
| EP | 1840238 | A2 | 10/2007 |
| EP | 1898065 | A1 | 3/2008 |
| EP | 2096290 | A1 | 9/2009 |
| EP | 1959099 | B1 | 6/2011 |
| EP | 2371987 | A2 | 10/2011 |
| GB | 1296967 | A | 11/1972 |
| JP | S58195050 | A | 11/1983 |
| JP | S61142320 | A | 6/1986 |
| JP | S61218715 | A | 9/1986 |
| JP | H04191413 | A | 7/1992 |
| JP | H09209830 | A | 8/1997 |
| JP | 2006112422 | A | 4/2006 |
| KR | 20100061432 | A | 6/2010 |

(56) References Cited

FOREIGN PATENT DOCUMENTS

| | | | |
|---|---|---|---|
| KR | 20130004709 | A | 1/2013 |
| RU | 2309271 | C2 | 10/2007 |
| WO | WO8802061 | A1 | 3/1988 |
| WO | WO8903930 | A1 | 5/1989 |
| WO | WO9313245 | A1 | 7/1993 |
| WO | WO9942710 | A1 | 8/1999 |
| WO | WO2006076161 | A1 | 7/2006 |
| WO | WO2010078463 | A1 | 7/2010 |
| WO | WO2012087550 | A1 | 6/2012 |
| WO | 2015-306591 | * | 5/2015 |
| WO | WO2015134162 | A1 | 9/2015 |
| WO | 2017087733 | A1 | 5/2017 |
| WO | 2017087734 | A1 | 5/2017 |
| WO | 2017160896 | A1 | 9/2017 |

OTHER PUBLICATIONS

Khor et al., Plasma sprayed functionally graded thermal barrier coatings, Materials Letters, North Holland Publishing Company, Amsterdam, NL, vol. 38, No. 6, Mar. 18, 1999, pp. 437-444 (Sections 1-3.2; Tables 3-5).

Chunxu Pan et al., Microstructural characteristics in plasma sprayed functionally graded ZrO2/NiCrAl coatings, vol. 162, No. 2-3, Jan. 20, 2003, pp. 194-201 (Sections 1-3.1; Tables 1, 2).

Oerlikon Metco: Thermal Spray Poweder Products: Ceria-Yttria Stabilized Zirconium Oxide HOSP Powder, Aug. 12, 2014, pp. 1-3, retrieved from the Internet Jan. 16, 2017: https://www.oerlikon.com/ecomaXL/files/oerlikon_DSMTS-0038.1_CeZrO.pdf&download=1.

Ahmadi-Pidani, R. et al., "Improving the hot corrosion resistance of plasma sprayed ceria-yttria stabilized zirconia thermal barrier coatings by laser surface treatment", Materials and Design, vol. 57 (2014), pp. 336-341.

Brindley, W. et al., "Thermal Barrier Coating Evaluation Needs", NASA Technical Memorandum 103708, Conference on Nondestructive Evaluation of Modern Ceramics, Columbus, OH, Jul. 9-12, 1990.

Buyukkaya, E. et al., "Effects of thermal barrier coating on gas emissions and performance of a LHR engine with different injection timings and valve adjustment", Energy Conversion and Management, vol. 47, Issues 9-10 (2006), pp. 1298-1310.

Carmona, D., "Thermal barrier coatings for efficient combustion", KTH Industrial Engineering and Management, Degree Project in Materials Science and Engineering, Second Cycle, Stockholm, Sweden, 2014.

Ciniviz, M. et al., "Ceramic Coating Applications and Research Fields for Internal Combustion Engines, Ceramic Coatings—Applications in Engineering", Prof. Feng Shi (Ed.), InTech, Feb. 2012, pp. 195-234, doi: 10.5772/29993; available from http://www.intechopen.com/books/ceramic-coatings-applications-in-engineering/ceramic-coating-applications-and-research-fields-for-internal-combusion-engines.

Dickey, D., "The Effect of Insulated Combustion Chamber Surfaces on Direct-Injected Diesel Engine Performance, Emissions and Combustion", SAE Technical Paper 890292, 1989, doi:10.4271/890292.

Jech, D. et al., "Structural Stability of Plasma Sprayed CoNiCrAlY—ZiO2+Y2O3 Thermal Barrier Coatings After Isothermal Exposure at 1050° C.", 22nd International Conference on Metallurgy and Materials (METAL), Brno, Czech Republic, May 2013.

Lee, J. et al, "Microstructure and thermal cyclic performance of laser-glazed plasma-sprayed ceria-yttria-stabilized zirconia thermal barrier coatings", Surface & Coatings Technology, vol. 202 (2008), pp. 5607-5612.

Levy, A. et al., "The Behavior of Ceramic Thermal Barrier Coatings on Diesel Engine Combustion Zone Components", Surface and Coatings Technology, vol. 30 (1987), pp. 51-61.

Modi, A., "Experimental Study of Energy Balance in Thermal Barrier Coated Diesel Engine", SAE Technical Paper 2012-01-0389, 2012, doi:10.4271/2012-01-0389.

Palaniswamy, E. et al, "Ceramic Coated Combustion Chamber for Improving IC Engine Performance", International Journal on Design and Manufacturing Technologies, vol. 2, No. 1, Jul. 2008, pp. 22-25.

Pandian, S. et al., "Thermal and Structural Analysis of Functionally Graded NiCrAlY/YSZ/Al2O3 Coated Piston", SAE Technical Paper 2015-01-9081, 2015, doi:10.4271/2015-01-9081.

Rupangudi, S. et al., "Study of Effect of Coating of Piston on the Performance of a Diesel Engine", SAE Technical Paper 2014-01-1024, 2014, doi: 10.4271/2014-01-1021.

Soltic, P. et al., "Catalytic Piston Coating", Conference Paper, 5. Conference on Gas Powered Vehicles, Berlin, Germany, Sep. 2010.

Winkler, M. et al, "Thermal Barrier Coatings for Diesel Engines: Ten Years of Experience", SAE Technical Paper 922438, 1992, doi:10.4271/922438.

Oerlikon Metco Material Product Data Sheet, Ceria-Yttria Stabilized Zirconium Oxide HOSP Powder, DSMTS-0038.1, 2014.

International Search Report, dated Feb. 20, 2017 (PCT/US2016/062648).

Jalaludin Helmisyah Ahmad et al, Experimental Study of Ceramic Coated Piston Crown for Compressed Natural Gas Direct Injection Engines, Procedia Engineering, vol. 68, Nov. 18, 2013, pp. 505-511 (Sections 2.1, 3.1; Figure 2; Table 1).

International Search Report, dated Jan. 22, 2019 (PCT/US2018/057661).

* cited by examiner

EXAMPLE 1:
50wt% ceramic/25wt% mix/25wt% bond consisting of CSZ/CSZ+bond/bond

| Layer | Component | % by mass |
|---|---|---|
| Top | CSZ | 50.0 |
| | YSZ | 0.0 |
| Mid | CSZ | 12.5 |
| | YSZ | 0.0 |
| | Bond | 12.5 |
| Bond | Bond only | 25.0 |

EXAMPLE 2:
50wt% ceramic/25wt% mix/25wt% bond consisting of (mix CSZ/YSZ)/(CSZ/YSZ)+bond/bond

| Layer | Component | % by mass |
|---|---|---|
| Top | CSZ | 25.0 |
| | YSZ | 25.0 |
| Mid | CSZ | 6.3 |
| | YSZ | 6.3 |
| | Bond | 12.5 |
| Bond | Bond only | 25.0 |

FIG. 5B

EXAMPLE 3:
50wt% ceramic/25wt% mix/25wt% bond consisting of YSZ/YSZ+bond/bond

| Layer | Component | % by mass |
|---|---|---|
| Top | CSZ | 0.0 |
| | YSZ | 50.0 |
| Mid | CSZ | 0.0 |
| | YSZ | 12.5 |
| | Bond | 12.5 |
| Bond | Bond only | 25.0 |

FIG. 5C

EXAMPLE 4:
Five layer coating transitioning from 100% bond to 100% ceramic

| Layer | Composition by mass % |
|---|---|
| Top CSZ | 20% of total coating, 100;0 CSZ:bond |
| Layer 4 | 20% of total coating, 75;25 CSZ:bond |
| Layer 3 | 20% of total coating, 50;50 CSZ:bond |
| Layer 2 | 20% of total coating, 25;75 CSZ:bond |
| Bond | 20% of total coating, 0;100 CSZ:bond |

FIG. 5D

THERMALLY INSULATED STEEL PISTON CROWN AND METHOD OF MAKING USING A CERAMIC COATING

CROSS-REFERENCE TO RELATED APPLICATIONS

This U.S. utility patent application claims the benefit of U.S. provisional patent application No. 62/257,993, filed Nov. 20, 2015, the entire contents of which are incorporated herein by reference.

BACKGROUND OF THE INVENTION

1. Field of the Invention

This invention relates generally to pistons for internal combustion engines, including insulated pistons for diesel engines, and methods of manufacturing the same.

2. Related Art

Modern heavy duty diesel engines are being pushed towards increased efficiency under emissions and fuel economy legislation. To achieve greater efficiency, the engines must run hotter and at higher peak pressures. Thermal losses through the combustion chamber become problematic under these increased demands. Typically, about 4% to 6% of available fuel energy is lost as heat through the piston into the cooling system. One way to improve engine efficiency is to extract energy from hot combustion gases by turbo-compounding. For example, about 4% to 5% of fuel energy can be extracted from the hot exhaust gases by turbo-compounding.

Another way to improve engine efficiency includes reducing heat losses to the cooling system by insulating the crown of the piston. Insulating layers, including ceramic materials, are one way of insulating the piston. One option includes applying a metal bonding layer to the metal body portion of the piston followed by a ceramic layer. However, the layers are discrete and the ceramic is by its nature porous. Thus, combustion gases can pass through the ceramic and start to oxidize the metal bonding layer at the ceramic/bonding layer interface, causing a weak boundary layer to form and potential failure of the coating over time. In addition, mismatches in thermal expansion coefficients between adjacent layers, and the brittle nature of ceramics, create the risk for delamination and spalling.

Another example is a thermally sprayed coating formed of yttria stabilized zirconia. This material, when used alone, can suffer destabilization through thermal effects and chemical attack in diesel combustion engines. It has also been found that thick ceramic coatings, such as those greater than 500 microns, for example 1 mm, are prone to cracking and failure.

Although more than 40 years of thermal coating development for pistons is documented in literature, there is no known product that is both successful and cost effective to date. It has also been found that typical aerospace coatings used for jet turbines are not suitable for engine pistons because of raw material and deposition costs associated with the highly cyclical nature of the thermal stresses imposed.

SUMMARY OF THE INVENTION

One aspect of the invention provides a piston, comprising a body portion formed of metal and including a crown presenting a combustion surface. A thermal barrier coating is applied to the crown and has a thickness extending from the combustion surface to an exposed surface. The thermal barrier coating includes a mixture of a metal bond material and a ceramic material; and the amount of ceramic material present in the thermal barrier coating increases from the combustion surface to the exposed surface.

Another aspect of the invention provides a method of manufacturing a piston. The method includes applying a thermal barrier coating to a combustion surface of a crown formed of metal. The thermal barrier coating has a thickness extending from the combustion surface to an exposed surface, and the thermal barrier coating includes a mixture of a metal bond material and a ceramic material. The step of applying the thermal barrier coating to the combustion surface includes increasing the amount of ceramic material relative to the metal bond material from the combustion surface to the exposed surface.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 discloses example compositions of the thermal barrier coating;

DETAILED DESCRIPTION OF EXAMPLE EMBODIMENTS

One aspect of the invention provides a piston 20 with a thermal barrier coating 22 for use in an internal combustion engine, such as a heavy duty diesel engine. The thermal barrier coating 22 reduces heat loss to the cooling system and thus improves engine efficiency. The thermal barrier coating 22 is also more cost effective and stable, as well as less susceptible to chemical attacks, compared to other coatings used to insulate pistons.

Figure 1:
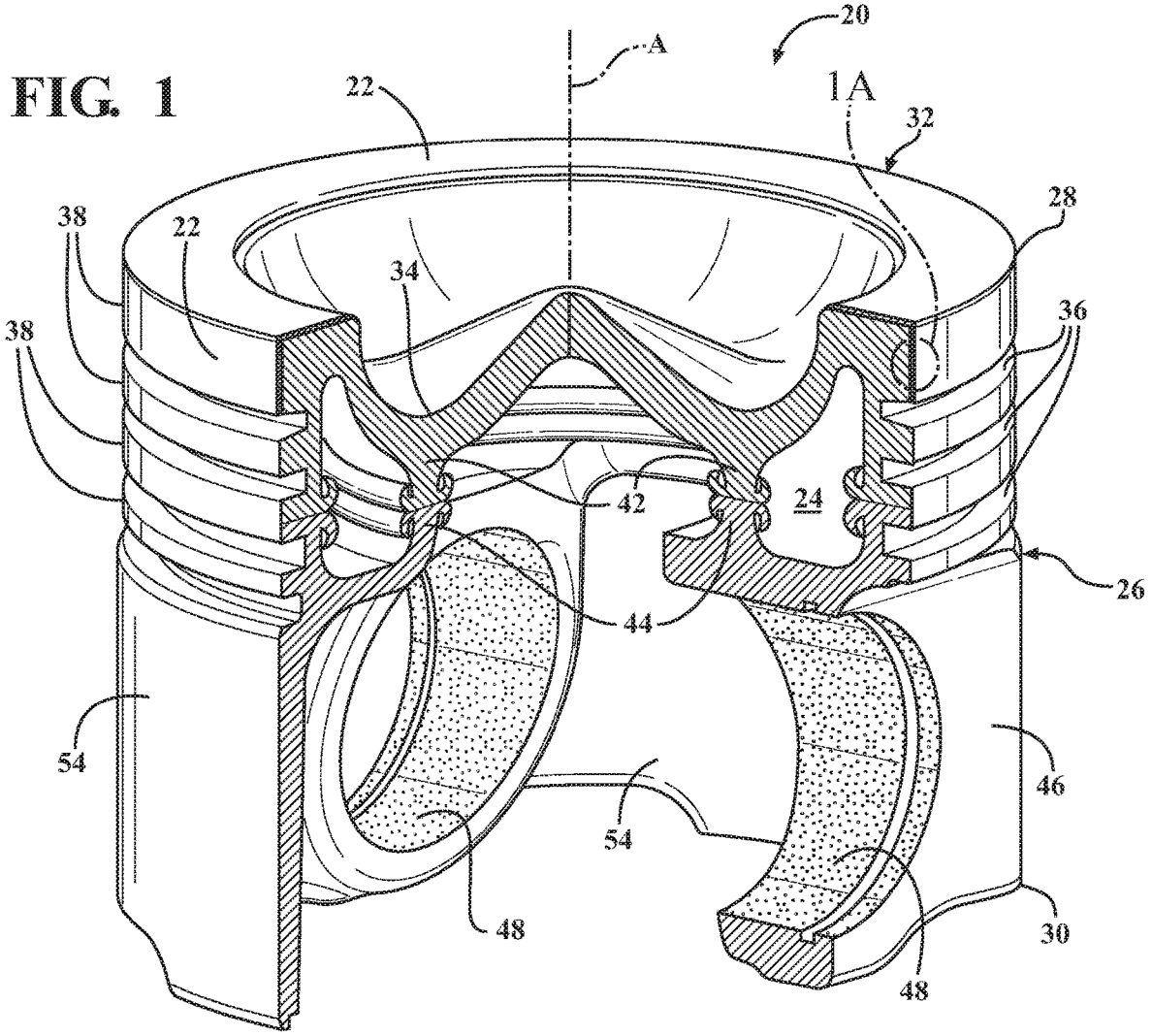
FIG. 1 is a perspective sectional view a gallery-containing diesel engine piston including a thermal barrier coating applied to the crown according to an example embodiment of the invention.

An example of the piston 20 including the thermal barrier coating 22 according to one example embodiment is shown in FIG. 1. The example piston 20 is designed for use in a heavy duty diesel engine, but the thermal barrier coating 22 can be applied to other types of pistons, and also to other components exposed to a combustion chamber of an internal combustion engine. In the example embodiment, the piston 20 includes a body portion 26 formed of a metal material, specifically steel. The steel used to form the body portion 26 can be an AISI 4140 grade or a microalloy 38MnSiVS5, for example. The steel used to form the body portion 26 does not include phosphate, and if any phosphate is present on the surface of the body portion 26, then that phosphate is removed prior to applying the thermal barrier coating 22. The body portion 26 extends around a center axis A and longitudinally along the center axis A from an upper end 28 to a lower end 30. The piston body portion 26 also includes a crown 32 extending circumferentially about the center axis A from the upper end 28 toward the lower end 30. In the embodiment of FIG. 1, the crown 32 is joined to the remainder of the body portion 26, in this case by welding.

The crown 32 of the piston 20 defines a combustion surface 34 at the upper end 28 which is directly exposed to hot gasses, and thus high temperatures and pressures, during use of the piston 20 in the internal combustion engine. In the example embodiment, the combustion surface 34 includes a combustion bowl extending from a planar outer rim, and the combustion surface 34 includes an apex at the center axis A. The crown 32 of the piston 20 also defines at least one ring groove 36 located at an outer diameter surface and extending circumferentially about the center axis A for receiving at least one ring (not shown). Typically the piston 20 includes two or three ring grooves 36. Ring lands 38 are disposed adjacent each ring groove 36 and space the ring grooves 36 from one another and from the combustion surface 34.

In the example of FIG. 1, the piston 20 includes a cooling gallery 24 extending circumferentially around the center axis A between the crown 32 and the remainder of the body portion 26. In this embodiment, the crown 32 includes an upper rib 42 spaced from the center axis A, and the adjacent section of the body portion 26 includes a lower rib 44 spaced from the center axis A. The upper rib 42 is welded to the lower rib 44 to form the cooling gallery 24. In this case, the ribs 42, 44 are friction welded together, but the ribs 42, 44 may be joined using other methods. The cooling gallery 24 can contain a cooling fluid to dissipate heat away from the hot crown 32 during use of the piston 20 in the internal combustion engine. In addition, cooling fluid or oil can be sprayed into the cooling gallery 24 or along an interior surface of the crown 32 to reduce the temperature of the crown 24 during use in the internal combustion engine.

As shown in FIG. 1, the body portion 26 of the piston 20 further includes a pair of pin bosses 46 spaced from one another about the center axis A and depending from the crown 32 to the lower end 30. Each pin boss 46 defines a pin bore 48 for receiving a wrist pin which can be used to connect the piston 20 to a connecting rod. The body portion 26 also includes a pair of skirt sections 54 spacing the pin bosses 46 from one another about the center axis A and depending from the crown 32 to the lower end 30.

Figure 2:
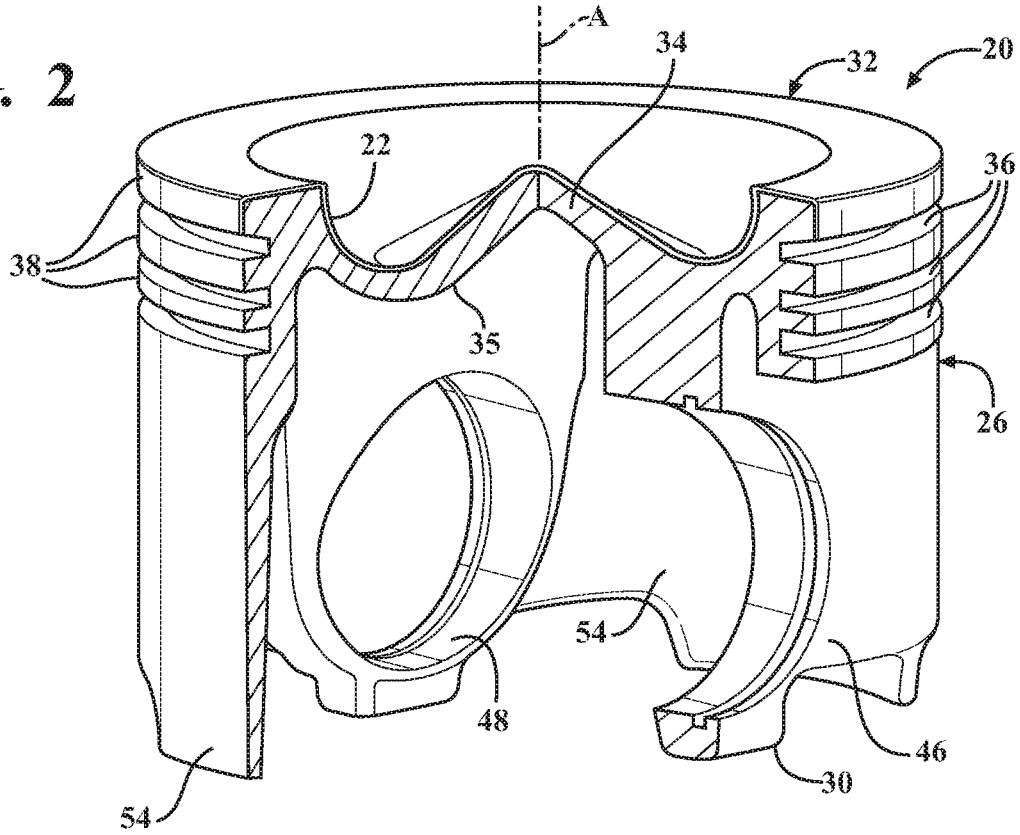
FIG. 2 is a perspective sectional view of a galleryless diesel engine piston including the thermal barrier coating applied to the crown according to another example embodiment of the invention.

According to another example embodiment shown in FIG. 2, the body portion 26 of the piston 20 is a galleryless piston. The galleryless piston 20 includes the crown 32 presenting the upper combustion surface 34 which is directly exposed to combustion gasses of a combustion chamber contained within a cylinder bore of the internal combustion engine. In the example embodiment, the combustion surface 34 includes the apex at the center axis A. The ring grooves 36 and ring lands 38 depend from the combustion surface 34 and extend circumferentially along an outer diameter of the piston 20. The galleryless piston 20 also includes the pin bosses 46 spaced from one another about the center axis A and depending from the crown 32 to the lower end 30. Each pin boss 46 defines the pin bore 48 for receiving a wrist pin which can be used to connect the piston 20 to a connecting rod. The body portion 26 also includes the skirt sections 54 spacing the pin bosses 46 from one another about the center axis A and depending from the crown 32 to the lower end 30. The entire body portion 26 of the galleryless piston 20 is typically forged or cast as a single piece.

An undercrown surface 35 of the piston 20 of FIG. 2 is formed on an underside of the crown 32, directly opposite the combustion surface 34 and radially inwardly of the ring grooves 36. The undercrown surface 35 is the surface on the direct opposite side from the combustion bowl. The undercrown surface 35 is defined here to be the surface that is visible, excluding any pin bores 48 when observing the piston 20 straight on from the bottom. The undercrown surface 35 is also openly exposed, as viewed from an underside of the piston 20, and it is not bounded by a sealed or enclosed cooling gallery.

In other words, when looking at the piston 20 from the bottom, the surface that presents itself is the undercrown surface 35 of the upper crown 32 and not, for example, a floor of a cooling gallery. Since the piston 20 is "galleryless," the bottoms of the cavities directly exposed to the undercrown surface 35 are uncovered and open from below. Unlike traditional gallery style pistons, the galleryless piston 20 lacks bottom floors or ledges that would normally serve to entrap a certain amount of cooling oil in the region or space immediately below the undercrown surface 35. The undercrown surface 35 of the present piston 20 is intentionally and fully open, and the exposure thereof is maximized.

The undercrown surface 35 of the piston 20 also has greater a total surface area (3-dimensional area following the contour of the surface) and a greater projected surface area (2-dimensional area, planar, as seen in plan view) than comparative pistons having a sealed or enclosed cooling gallery. This open region along the underside of the piston 20 provides direct access to oil splashing or being sprayed from within a crankcase directly onto the undercrown surface 35, thereby allowing the entire undercrown surface 35 to be splashed directly by oil from within the crankcase, while also allowing the oil to freely splash about the wrist pin and further, significantly reduce the weight of the piston 20. Accordingly, although not having a typical closed or partially closed cooling gallery, the generally open configuration of the galleryless piston 20 allows optimal cooling of the undercrown surface 35 and lubrication to the wrist pin within the pin bores 48, while at the same time reducing oil residence time on the surfaces near the combustion bowl, which is the time in which a volume of oil remains on the surface. The 2-dimensinional and 3-dimensional surface area of the undercrown surface 35 is typically maximized so that cooling caused by oil splashing or being sprayed upwardly from the crankcase against the exposed surface can be enhanced, thereby lending to exceptional cooling of the piston 20.

As shown in FIG. 1, the thermal barrier coating 22 is applied to the combustion surface 34 and at least one of the ring lands 38 of the piston 20 to reduce heat loss to the combustion chamber and thus increase efficiency of the engine. In the example embodiment, the thermal barrier coating 22 is applied to the uppermost ring land 38 directly adjacent said combustion surface 34. The thermal barrier coating 22 can also be applied to other portions of the piston 20, and optionally other components exposed to the combustion chamber, such as liner surfaces, valves, and cylinder heads, in addition to the piston 20. The thermal barrier coating 22 is oftentimes disposed in a location aligned with and/or adjacent to the location of the fuel injector, fuel plumes, or patterns from heat map measurements in order to modify hot and cold regions along the crown 32.

The thermal barrier coating 22 is designed for exposure to the harsh conditions of the combustion chamber. For example, the thermal barrier coating 22 can be applied to a diesel engine piston which is subject to large and oscillating thermal cycles. Such pistons experience extreme cold start temperatures and reach up to 700° C. when in contact with combustion gases. There is also temperature cycling from each combustion event of approximately 15 to 20 times a second or more. In addition, pressure swings up to 250 to 300 bar are seen with each combustion cycle.

A portion of the thermal barrier coating 22 is formed of a ceramic material 50, specifically at least one oxide, for example ceria, ceria stabilized zirconia, yttria stabilized zirconia, calcia stabilized zirconia, magnesia stabilized zirconia, zirconia stabilized by another oxide, and/or a mixture thereof. The ceramic material 50 has a low thermal conductivity, such as less than 1 W/m·K. When ceria is used in the ceramic material 50, the thermal barrier coating 22 is more stable under the high temperatures, pressures, and other harsh conditions of a diesel engine. The composition of the ceramic material 50 including ceria also makes the thermal barrier coating 22 less susceptible to chemical attack than other ceramic coatings, which can suffer destabilization when used alone through thermal effects and chemical attack in diesel combustion engines. Ceria and ceria stabilized zirconia are much more stable under such thermal and chemical conditions. Ceria has a thermal expansion coefficient which is similar to the steel material used to form the piston body portion 26. The thermal expansion coefficient of ceria at room temperature ranges from 10E-6 to 11E-6, and the thermal expansion coefficient of steel at room temperature ranges from 11E-6 to 14E-6. The similar thermal expansion coefficients help to avoid thermal mismatches that produce stress cracks.

In one embodiment, the ceramic material 50 used to form the thermal barrier coating 22 includes ceria in an amount of 90 to 100 wt. %, based on the total weight of the ceramic material 50. In another example embodiment, the ceramic material 50 includes ceria stabilized zirconia in an amount of 90 to 100 wt. %, based on the total weight of the ceramic material 50. In another example embodiment, the ceramic material 50 includes yttria stabilized zirconia in an amount of 90 to 100 wt. %, based on the total weight of the ceramic material 50. In yet another example embodiment, the ceramic material 50 includes ceria stabilized zirconia and yttria stabilized zirconia in a total amount of 90 to 100 wt. %, based on the total weight of the ceramic material 50. In another example embodiment, the ceramic material 50 includes magnesia stabilized zirconia, calcia stabilized zirconia, and/or zirconia stabilized by another oxide in an amount of 90 to 100 wt. %, based on the total weight of the ceramic material 50. In other words, any of the oxides can be used alone or in combination in an amount of 90 to 100 wt. %, based on the total weight of the ceramic material 50. In cases where the ceramic material 50 does not consist entirely of the ceria, ceria stabilized zirconia, yttria stabilized zirconia, magnesia stabilized zirconia, calcia stabilized zirconia, and/or zirconia stabilized by another oxide, the remaining portion of the ceramic material 50 typically consists of other oxides and compounds such as aluminum oxide, titanium oxide, chromium oxide, silicon oxide, manganese or cobalt compounds, silicon nitride, and/or or functional materials such as pigments or catalysts. For example, according to one embodiment, a catalyst is added to the thermal barrier coating 22 to modify combustion. A color compound can also be added to the thermal barrier coating 22. According to one example embodiment, thermal barrier coating 22 is a tan color, but could be other colors, such as blue or red.

According to one embodiment, wherein the ceramic material 50 includes ceria stabilized zirconia, the ceramic material 50 includes the ceria in an amount of 20 wt. % to 25 wt. % and the zirconia in an amount of 75 wt. % to 80 wt. %, based on the total amount of ceria stabilized zirconia in the ceramic material 50. Alternatively, the ceramic material 50 can include up to 3 wt. % yttria, and the amount of zirconia is reduced accordingly. In this embodiment, the ceria stabilized zirconia is provided in the form of particles having a nominal particle size of 11 μm to 125 μm. Preferably, 90 wt. % of the ceria stabilized zirconia particles have a nominal particle size less than 90 μm, 50 wt. % of the ceria stabilized zirconia particles have a nominal particle size less than 50 μm, and 10 wt. % of the ceria stabilized zirconia particles have a nominal particle size less than 25 μm.

According to another example embodiment, wherein the ceramic material 50 includes yttria stabilized zirconia, the ceramic material 50 includes the yttria in an amount of 7 wt. % to 9 wt. %, and the zirconia in an amount of 91 wt. % to 93 wt. %, based on the amount of yttria stabilized zirconia in the ceramic material 50. In this embodiment, the yttria stabilized zirconia is provided in the form of particles having a nominal particle size of 11 μm to 125 μm. Preferably, 90 wt. % of the yttria stabilized zirconia particles have a particle size less than 109 μm, 50 wt. % of the yttria stabilized zirconia particles have a particle size less than 59 μm, and 10 wt. % of the yttria stabilized zirconia particles have a particle size less than 28 μm.

According to another example embodiment, wherein the ceramic material 50 includes a mixture of ceria stabilized zirconia and yttria stabilized zirconia, the ceramic material 50 includes the ceria stabilized zirconia in an amount of 5 wt. % to 95 wt. %, and the yttria stabilized zirconia in an amount of 5 wt. % to 95 wt. %, based on the total amount of the mixture present in the ceramic material 50. In this embodiment, the ceria stabilized zirconia is provided in the form of particles having a nominal particle size of 11 μm to 125 μm. Preferably, 90 wt. % of the ceria stabilized zirconia particles have a particle size less than 90 μm, 50 wt. % of the ceria stabilized zirconia particles have a particle size less than 50 μm, and 10 wt. % of the ceria stabilized zirconia particles have a particle size less than 25 μm. The yttria stabilized zirconia is also provided in the form of particles having a nominal particle size of 11 μm to 125 μm. Preferably, 90 wt. % of the yttria particles have a particle size less than 109 μm, 50 wt. % of the yttria stabilized zirconia particles have a particle size less than 59 μm, and 10 wt. % of the yttria stabilized zirconia particles have a particle size less than 28 μm. When the ceramic material 50 includes the mixture of ceria stabilized zirconia and yttria stabilized zirconia, the ceramic material can be formed by adding 5 wt. % to 95 wt. % of ceria stabilized zirconia to the balance of yttria stabilized zirconia in the total 100 wt. % mixture.

According to yet another example embodiment, wherein the ceramic material 50 includes calcia stabilized zirconia, the ceramic material 50 includes the calcia in an amount of 4.5 wt. % to 5.5 wt. %, and the zirconia in an amount of 91.5 wt. %, with the balance consisting of other oxides in the ceramic material 50. In this embodiment, the calcia stabilized zirconia is provided in the form of particles having a nominal particle size range of 11 μm to 90 μm. Preferably, the calcia stabilized zirconia particles contain a maximum of 7 wt. % with particle size greater than 45 μm and up to 65 wt. % of particles less than 45 μm.

According to yet another example embodiment, wherein the ceramic material 50 includes magnesia stabilized zirconia, the ceramic material 50 includes the magnesia in an amount of 15 wt. % to 30 wt. %, with the balance consisting of zirconia. In this embodiment, the magnesia stabilized zirconia is provided in the form of particles having a nominal particle size of 11 μm to 90 μm. Preferably, 15 wt. % of the magnesia stabilized zirconia particles have a particle size less than 88 μm.

Other oxides or mixtures of oxides may be used to stabilize the ceramic material 50. The amount of other oxide or mixed oxides is typically in the range 5 wt. % to 38 wt. %, and the nominal particle size range of the stabilized ceramic material 50 is 1 μm to 125 μm.

The porosity of the ceramic material 50 is typically controlled to reduce the thermal conductivity of the thermal barrier coating 22. When a thermal spray method is used to apply the thermal barrier coating 22, the porosity of the ceramic material 50 is typically less than 25% by vol., such as 2% by vol. to 25% by vol. preferably 5% by vol. to 15% by vol., and more preferably 8% by vol. to 10% by vol., based on the total volume of the ceramic material 50. However, if a vacuum method is used to apply the thermal barrier coating 22, then the porosity is typically less than 5% by vol., based on the total volume of the ceramic material 50. The pores of the thermal barrier coating 22 are typically concentrated in the ceramic regions. The porosity of the thermal barrier coating 22 contributes to the reduced thermal conductivity of the thermal barrier coating 22.

The thermal barrier coating 22 is also applied in a gradient structure 51 to avoid discrete metal/ceramic interfaces. In other words, the gradient structure 51 avoids sharp interfaces. Thus, the thermal barrier coating 22 is less likely to de-bond during service. The gradient structure 51 of the thermal barrier coating 22 is formed by first applying a metal bond material 52 to the piston body portion 26, followed by a mixture of the metal bond material 52 and ceramic material 50, and then the ceramic material 50.

The composition of the metal bond material 52 can be the same as the powder used to form the piston body portion 26, for example a steel powder. Alternatively the metal bond material 52 can comprise a high performance superalloy, such as those used in coatings of jet turbines. According to example embodiments, the metal bond material 52 includes or consists of at least one of alloy selected from the group consisting of CoNiCrAlY, NiCrAlY, NiCr, NiAl, NiCrAl, NiAlMo, and NiTi. The thermal barrier coating 22 typically includes the metal bond material 52 in an amount of 5% by vol. to 33% by vol. %, more preferably 10% by vol. to 33% by vol., most preferably 20% by vol. to 33% by vol., based on the total volume of the thermal barrier coating 22. The metal bond material 52 is provided in the form of particles having a particle size of −140 mesh (<105 μm), preferably −170 mesh (<90 μm), more preferably −200 mesh (<74 μm), and most preferably −400 mesh (<37 μm). According to one example embodiment, the thickness of the metal bond material 52 ranges from 30 microns to 1 mm. The thickness limit of the metal bond material 52 is dictated by the particle size of the metal bond material 52. A low thickness is oftentimes preferred to reduce the risk of delamination of the thermal barrier coating 22.

The gradient structure 51 is formed by gradually transitioning from 100% metal bond material 52 to 100% ceramic material 50. The thermal barrier coating 22 includes the metal bond material 52 applied to the body portion 26, followed by increasing amounts of the ceramic material 50 and reduced amounts of the metal bond material 52. The transition function of the gradient structure 51 can be linear, exponential, parabolic, Gaussian, binomial, or could follow another equation relating composition average to position.

The uppermost portion of the thermal barrier coating 22 is formed entirely of the ceramic material 50. The gradient structure 51 helps to mitigate stress build up through thermal mismatches and reduces the tendency to form a continuous weak oxide boundary layer at the interface of the ceramic material 50 and the metal bond material 52.

Figure 1A:
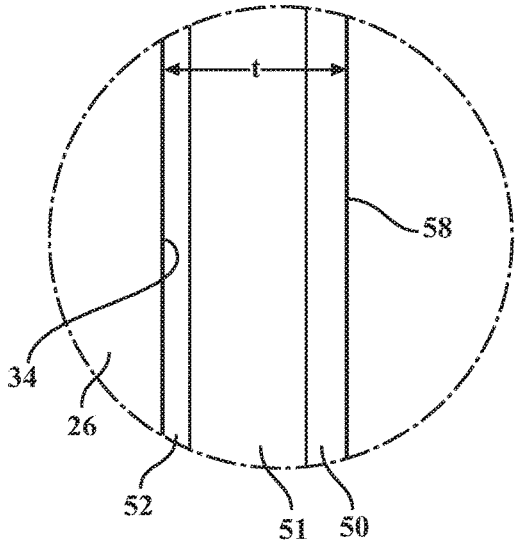
FIG. 1A is an enlarged view of a portion of the thermal barrier coating applied to the piston crown of FIG. 1.
Figure 6:
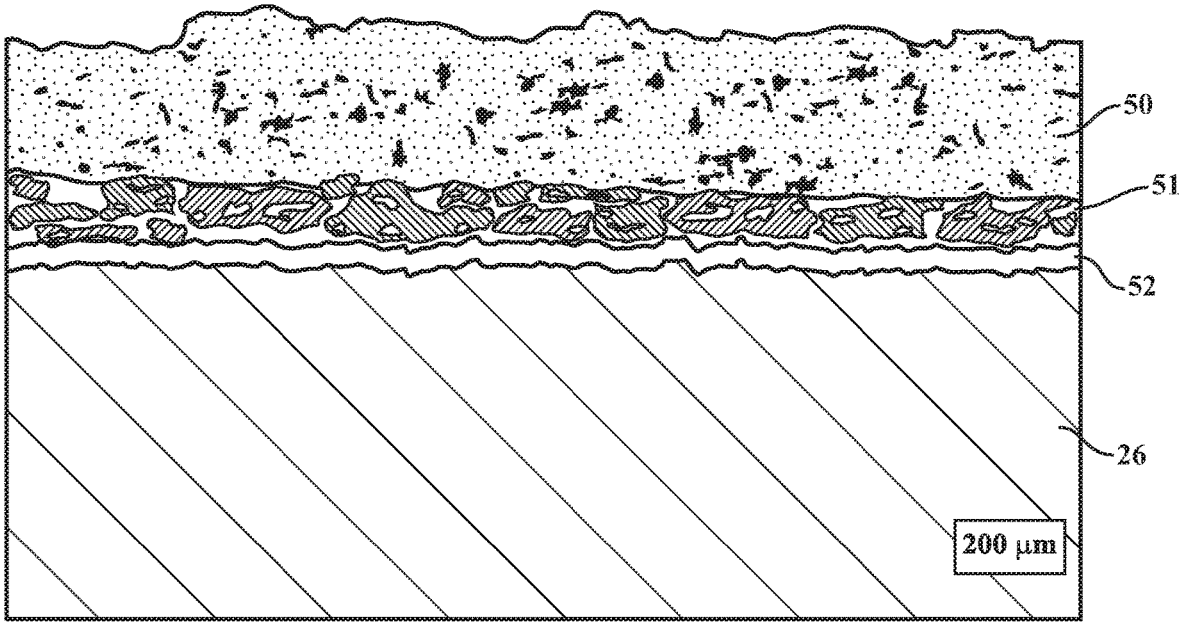
FIG. 6 is a cross-sectional view showing an example of the thermal barrier coating disposed on a steel piston crown.

According to one embodiment, as shown in FIG. 1A, the lowermost portion of the thermal barrier coating 22 applied directly to the combustion surface 34 and/or ring lands 38 of the piston 20 consists of the metal bond material 52. Typically, 5% to 20% of the entire thickness of the thermal barrier coating 22 is formed of 100% metal bond material 52. In addition, the uppermost portion of the thermal barrier coating 22 can consist of the ceramic material 50. For example, 5% to 50% of the entire thickness of the thermal barrier coating 22 could be formed of 100% ceramic material 50. The gradient structure 51 of the thermal barrier coating 22 which continuously transitions from the 100% metal bond material 52 to the 100% ceramic material 50 is located therebetween. Typically, 30% to 90% of the entire thickness of the thermal barrier coating 22 is formed of the gradient structure 51. Example compositions of the thermal barrier coating 22 including ceria stabilized zirconia (CSZ), yttria stabilized zirconia (YSZ), and metal bond material (Bond) are disclosed in FIG. 5. It is also possible that 10% to 90% of the entire thickness of the thermal barrier coating 22 is formed of a layer of the metal bond layer 52, up to 80% of the thickness of the thermal barrier coating 22 is formed of the gradient structure 51, and 10% to 90% of the entire thickness of the thermal barrier coating 22 is formed of a layer of the ceramic material 50. FIG. 6 is a cross-sectional view showing an example of the thermal barrier coating 22 disposed on the crown 32.

Figure 7:
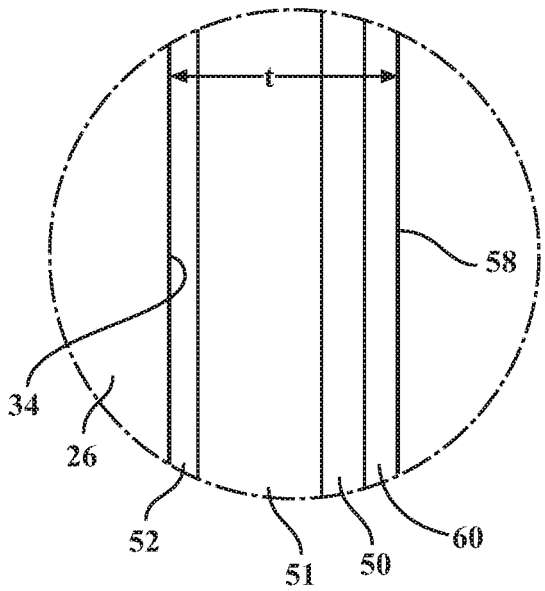
FIG. 7 is an enlarged view of a portion of the thermal barrier coating according to another example embodiment.

In its as-sprayed form, the thermal barrier coating 22 typically has a surface roughness Ra of less than 15 μm, and a surface roughness Rz of not greater than ≤110 μm. The thermal barrier coating 22 can be smoothed. At least one outer layer 60 formed of metal can be applied to the outermost surface of the thermal barrier coating 22, as shown in FIG. 7. The outer layer 60 can have the same composition as the metal bonding material 52, or another composition. The outer layer 60 could also have the surface roughness Ra of less than 15 μm, and a surface roughness Rz of not greater than ≤110 μm. Roughness can affect combustion by trapping fuel in cavities on the surface of the coating. It is typically desirable to avoid coated surfaces rougher than the examples described herein.

The thermal barrier coating 22 has a low thermal conductivity to reduce heat flow through the thermal barrier coating 22. Typically, the thermal conductivity of the thermal barrier coating 22 having a thickness of less than 1 mm, is less than 1.00 W/m·K, preferably less than 0.5 W/m·K, and most preferably not greater than 0.23 W/m·K. The specific heat capacity of the thermal barrier coating 22 depends on the specific composition used, but typically ranges from 480 J/kg·K to 610 J/kg·K at temperatures between 40 and 700° C. The low thermal conductivity of the thermal barrier coating 22 is achieved by the relatively high porosity of the ceramic material 50. Due to the composition and low thermal conductivity of the thermal barrier coating 22, the thickness of the thermal barrier coating 22 can be reduced, which reduces the risk of cracks or spalling, while achieving the same level of insulation relative to comparative coatings of greater thickness. It is noted that the advantageous low thermal conductivity of the thermal barrier coating 22 is not expected. When the ceramic material 50 of the thermal barrier coating 22 includes ceria stabilized zirconia, the thermal conductivity is especially low.

The bond strength of the thermal barrier coating 22 is also increased due to the gradient structure 51 present in the thermal barrier coating 22 and the composition of the metal used to form the body of the piston 20. The bond strength of the thermal barrier coating 22 having a thickness of 0.38 mm is typically at least 2000 psi when tested according to ASTM C633.

The thermal barrier coating 22 with the gradient structure 51 can be compared to a comparative coating having a two layer structure, which is typically less successful than the thermal barrier coating 22 with the gradient structure 51. The comparative coating includes a metal bond layer applied to a metal substrate followed by a ceramic layer with discrete interfaces through the coating. In this case, combustion gases can pass through the porous ceramic layer and can begin to oxidize the bond layer at the ceramic/bond layer interface. The oxidation causes a weak boundary layer to form, which harms the performance of the coating.

However, the thermal barrier coating 22 with the gradient structure 51 can provide numerous advantages. The thermal barrier coating 22 is applied to the combustion surface 34 and optionally the ring lands 38 of the piston 20 to provide a reduction in heat flow through the piston 20. The reduction in heat flow is at least 50%, relative to the same piston without the thermal barrier coating 22 on the combustion surface 34 or ring lands 38. By reducing heat flow through the piston 20, more heat is retained in the exhaust gas produced by the engine, which leads to improved engine efficiency and performance.

The thermal barrier coating 22 of the present invention has been found to adhere well to the steel piston body portion 26. However, for additional mechanical anchoring, the surfaces of the piston 20 to which the thermal barrier coating 22 is applied is typically free of any edge or feature having a radius of less than 0.1 mm. In other words, the surfaces of the piston 20 to which the thermal barrier coating 22 is preferably free of any sharp edges or corners.

Figure 3:
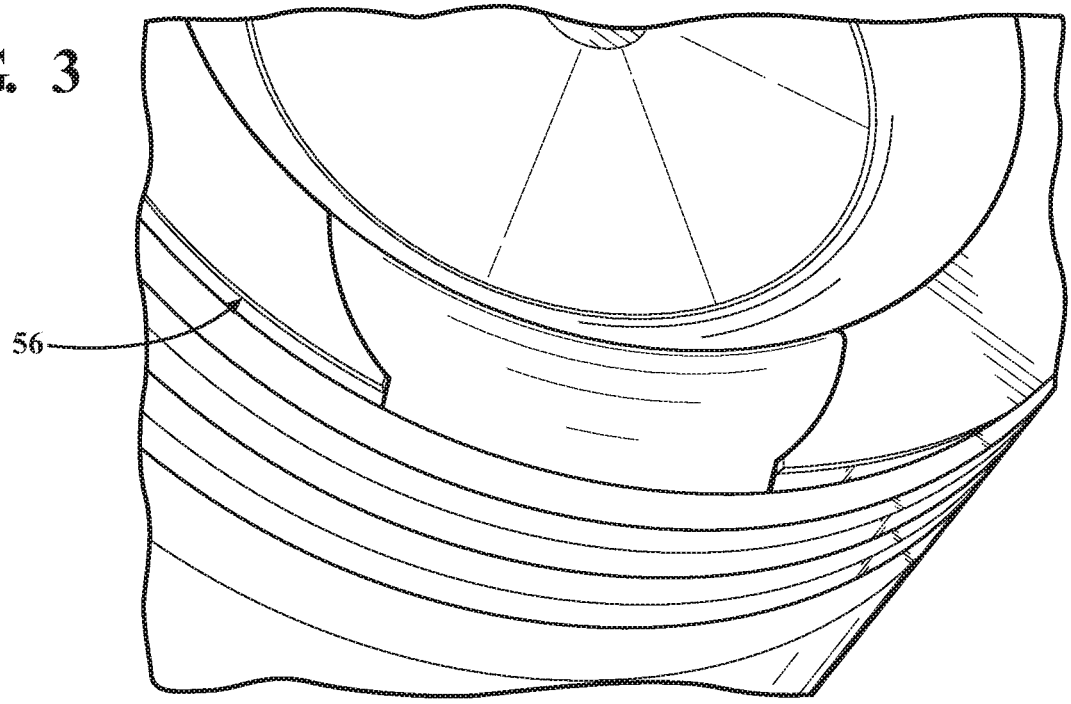
FIG. 3 illustrates a portion of a piston crown including a chamfered edge prior to applying the thermal barrier coating according to an example embodiment.
Figures 4, 5A:
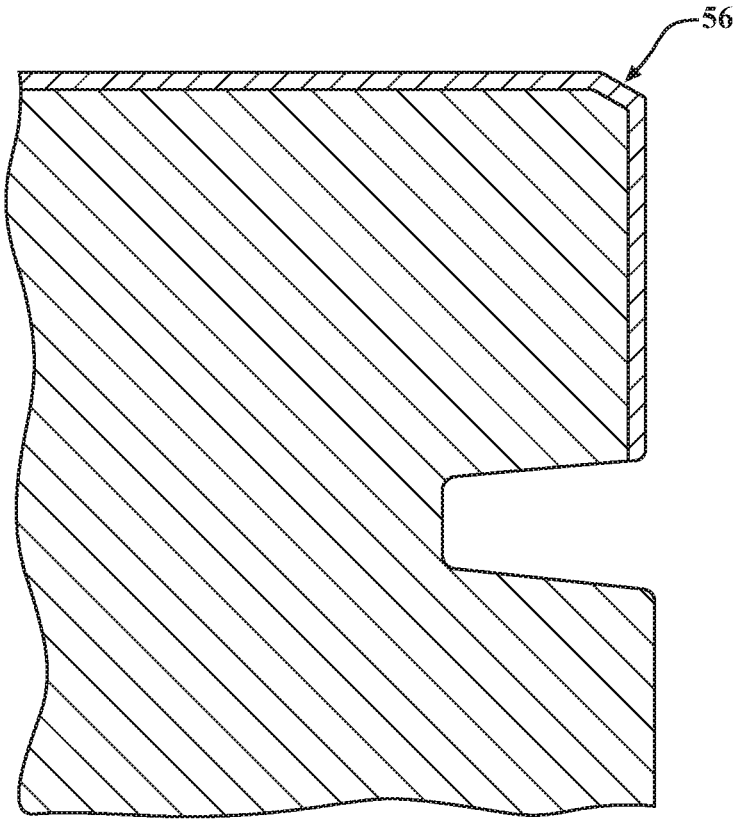
FIG. 4 is a side view of a portion of the piston crown including the chamfered edge prior to applying the thermal barrier coating according to an example embodiment.

According to one example embodiment, the piston 20 includes a broken edge or chamfer 56 machined along an outer diameter surface of the crown 32, between the combustion surface 34 and the uppermost ring land 38, as shown in FIGS. 3 and 4. The chamfer 56 allows the thermal barrier coating 22 to creep over the edge of the combustion surface 34 and radially lock to the crown 32 of the piston 20. Alternatively, at least one pocket, recess, or round edge could be machined along the combustion surface 34 and/or ring lands 38 of the piston crown 32. These features help to avoid stress concentrations in the thermal sprayed coating 22 and avoid sharp corners or edges that could cause coating failure. The machined pockets or recesses also mechanically lock the coating 22 in place, again reducing the probability of delamination failure.

Another aspect of the invention provides a method of manufacturing the coated piston 20 for use in the internal combustion engine, for example a diesel engine. The piston body portion 26, which is typically formed of steel, can be manufactured according to various different methods, such as forging or casting. The method can also include welding the piston crown 32 to the lower section of the piston body portion 26. As discussed above, the piston 20 can comprise various different designs. Prior to applying the thermal barrier coating 22 to the body portion 26, any phosphate or other material located on the surface to which the thermal barrier coating 22 is applied must be removed.

The method next includes applying the thermal barrier coating 22 to the piston 20. The thermal barrier coating 22 can be applied to the entire combustion surface 34 of the piston 20, or only a portion of the combustion surface 34. The ceramic material 50 and metal bond material 52 are provided in the form of particles or powders. The particles can be hollow spheres, spray dried, spray dried and sintered, sol-gel, fused, and/or crushed. In addition to the combustion surface 34, or as an alternative, the thermal barrier coating 22 can be applied to the ring lands 38, or a portion of the ring lands 38. In the example embodiment, the method includes applying the metal bond material 52 and the ceramic material 50 by a thermal or kinetic method. According to one embodiment, a thermal spray technique, such as plasma spraying, flame spraying, or wire arc spraying, is used to form the thermal barrier coating 22. High velocity oxy-fuel (HVOF) spraying is a preferred example of a kinetic method that gives a denser coating. Other methods of applying the thermal barrier coating 22 to the piston 20 can also be used. For example, the thermal barrier coating 22 could be applied by a vacuum method, such as physical vapor deposition or chemical vapor deposition. According to one embodiment, HVOF is used to apply a dense layer of the metal bond material 52 to the crown 32, and a thermal spray technique, such as plasma spray, is used to apply the gradient structure 51 and the layer of ceramic material 50. Also, the gradient structure 51 can be applied by changing feed rates of twin powder feeders while the plasma sprayed coating is being applied.

The example method begins by spraying the metal bond material 52 in an amount of 100 wt. % and the ceramic material 50 in an amount of 0 wt. %, based on the total weight of the materials being sprayed. Throughout the spraying process, an increasing amount of ceramic material 50 is added to the composition, while the amount of metal bond material 52 is reduced. Thus, the composition of the thermal barrier coating 22 gradually changes from 100% metal bond material 52 at the piston body portion 26 to 100% ceramic material 50 at an exposed surface 58. Multiple powder feeders are typically used to apply the thermal barrier coating 22, and their feed rates are adjusted to achieve the gradient structure 51. The gradient structure 51 of the thermal barrier coating 22 is achieved during the thermal spray process.

The thermal barrier coating 22 can be applied to the entire combustion surface 34 and ring lands 38, or a portion thereof. Non-coated regions of the body portion 26 can be masked during the step of applying the thermal barrier coating 22. The mask can be a re-usable and removal material applied adjacent the region being coated. Masking can also be used to introduce graphics in the thermal barrier coating 22. In addition, after the thermal barrier coating 22 is applied, the coating edges are blended, and sharp corners or edges are reduced to avoid high stress regions.

As shown in FIG. 1A, the thermal barrier coating 22 has a thickness t extending from the combustion surface 34 to the exposed surface 58. According to example embodiments, the thermal barrier coating 22 is applied to a total thickness t of not greater than 1.0 mm, or not greater than 0.7 mm, preferably not greater than 0.5 mm, and most preferably not greater than 0.380 mm. This total thickness t preferably includes the total thickness of the thermal barrier coating 22 and also any additional or sealant layer applied to the uppermost surface of the thermal barrier coating 22. However, the thickness t could be greater when the additional layers are used. The thickness t can be uniform along the entire surface of the piston 20, but typically the thickness t varies along the surface of the piston 20. In certain regions of the piston 20, for example where a shadow from a plasma gun is located, the thickness t of the thermal barrier coating 22 can be as low as 0.020 mm to 0.030 mm. In other regions of the piston 20, for example at the apex of the combustion surface 34 or regions which are in line with and/or adjacent to fuel injectors, the thickness t of the thermal barrier coating 22 is increased. For example, the method can include aligning the piston body portion 26 in a specific location relative to the fuel plumes by fixing the piston body portion 26 to prevent rotation, using a scanning gun in a line, and varying the speed of the spray or other technique used to apply the thermal barrier coating 22 to adjust the thickness t of the thermal barrier coating 22 over different regions of the piston body portion 26.

In addition, more than one layer of the thermal barrier coating 22, such as 5-10 layers, having the same or different compositions, could be applied to the piston 20. Furthermore, coatings having other compositions could be applied to the piston 20 in addition to the thermal barrier coating 22.

According to one example embodiment, the outer layer 60 formed of metal, such as an electroless nickel layer, is applied over the thermal barrier coating 22 to provide a seal against fuel absorption, prevent thermally grown oxides, and prevent chemical degradation of the ceramic material 50. The thickness of the outer layer is preferably from 1 to 50 microns. If the outer layer 60 is present, the porosity of the thermal barrier coating 22 could be increased. Alternatively, the outer layer 60 formed of the metal bonding material 52 can be applied over the ceramic material 50 of the thermal barrier coating 22.

Prior to applying the thermal barrier coating 22, the surface of the piston crown 32 is washed in solvent to remove contamination. Next, the method typically includes removing any edge or feature having a radius of less than 0.1 mm. The method can also include forming the broken edges or chamfer 56, or another feature that aids in mechanical locking of the thermal barrier coating 22 to the piston body portion 26 and reduce stress risers, in the piston crown 32. These features can be formed by machining, for example by turning, milling or any other appropriate means. The method can also include grit blasting surfaces of the piston body portion 26 prior to applying the thermal barrier coating 22 to improve adhesion of the thermal barrier coating 22.

After the thermal barrier coating 22 is applied to the piston body portion 26, the coated piston 20 can be abraded to remove asperities and achieve a smooth surface. The method can also include forming a marking on the surface of the thermal barrier coating 22 for the purposes of identification of the coated piston 20 when the piston 20 is used in the market. The step of forming the marking typically involves re-melting the thermal barrier coating 22 with a laser. According to other embodiments, an additional layer of graphite, thermal paint, or polymer is applied over the thermal barrier coating 22. If the polymer coating is used, the polymer burns off during use of the piston 20 in the engine. The method can include additional assembly steps, such as washing and drying, adding rust preventative and also packaging. Any post-treatment of the coated piston 20 must be compatible with the thermal barrier coating 22.

Obviously, many modifications and variations of the present invention are possible in light of the above teachings and may be practiced otherwise than as specifically described while within the scope of the following claims.

The invention claimed is:

1. A piston, comprising:

a body portion formed of metal;

said body portion including a crown presenting a combustion surface;

a thermal barrier coating applied to said crown and extending from said combustion surface to an exposed surface;

said thermal barrier coating including a mixture of a metal bond material and a ceramic material;

the amount of ceramic material present in the mixture increasing toward said exposed surface, and said thermal barrier coating has a thermal conductivity of less than 0.5 W/m·K.

2. The piston of claim 1, wherein a porosity of said ceramic material is 2% by vol. to 25% vol., based on the total volume of said ceramic material.

3. The piston of claim 1, wherein said thermal barrier coating has a thickness extending from said combustion surface to said exposed surface, and said thickness of said thermal barrier coating is less than 1 mm.

4. The piston of claim 1, wherein said ceramic material of said thermal barrier coating includes at least one of ceria, ceria stabilized zirconia, yttria stabilized zirconia, calcia stabilized zirconia, magnesia stabilized zirconia, and zirconia stabilized by another oxide.

5. The piston of claim 1, wherein said ceramic material consists of ceria stabilized zirconia.

6. The piston of claim 1, wherein said thermal barrier coating includes a layer of said metal bond material applied directly to said combustion surface of said crown, said thermal barrier coating has a thickness extending from said combustion surface to said exposed surface, and 5% to 20% of said thickness of said thermal barrier coating consists of said layer of metal bond material;

said thermal barrier coating includes said mixture applied directly to said layer of metal bond material, the amount of said ceramic material present in said mixture increases continuously from said layer of said metal bond material toward said exposed surface; and said thermal barrier coating includes a layer of said ceramic material applied directly to said mixture and extending to said exposed surface, and 5% to 50% of said thickness of said thermal barrier coating consists of said layer of said ceramic material.

7. The piston of claim 1, wherein said metal bond material includes at least one alloy selected from the group consisting of CoNiCrAlY, NiCrAlY, NiCr, NiAl, NiCrAl, NiAlMo, and NiTi.

8. The piston of claim 1, wherein said combustion surface of said crown to which said thermal barrier coating is applied is free of any features having a radius of less than 0.1 mm.

9. The piston of claim 1, wherein said thermal barrier coating applied to said combustion surface has a bond strength of at least 2000 psi when tested according to ASTM C633.

10. The piston of claim 1, wherein said thermal barrier coating is applied to a first portion of said combustion surface and not applied to a second portion of said combustion surface, and said thermal barrier coating has a thickness of not greater than 0.380 mm along said first portion.

11. The piston of claim 1, wherein said body portion is formed of steel, said body portion includes no phosphate, and no phosphate is present on said combustion surface of said crown to which said thermal barrier coating is applied;

said crown extends circumferentially about a center axis from an upper end toward a lower end of said body portion;

said combustion surface of said crown includes a combustion bowl extending from an outer rim, and said combustion bowl includes an apex at said center axis;

said crown includes ring grooves located at an outer diameter surface and extending circumferentially about said center axis;

said crown includes ring lands spacing said ring grooves from one another and from said combustion surface;

said combustion surface of said crown to which said thermal barrier coating is applied is free of any features having a radius of less than 0.1 mm, or said crown includes a chamfer extending from said combustion surface to one of said ring lands located adjacent said combustion surface;

said body portion includes a pair of pin bosses spaced from one another about said center axis and depending from said crown to said lower end, each of said pin bosses defining a pin bore;

said body portion includes a pair of skirt sections spacing said pin bosses from one another about said center axis and depending from said crown to said lower end;

said thermal barrier coating is applied to at least one of said ring lands;

said ceramic material of said thermal barrier coating includes at least one of ceria, ceria stabilized zirconia, yttria stabilized zirconia, calcia stabilized zirconia, magnesia stabilized zirconia, and zirconia stabilized by another oxide;

said ceramic material has a porosity of 2% by vol. to 15% by vol., based on the total volume of said ceramic material;

said metal bond material includes at least one alloy selected from the group consisting of CoNiCrAlY, NiCrAlY, NiCr, NiAl, NiCrAl, NiAlMo, and NiTi;

said thermal barrier coating includes said metal bond material in an amount of 5% by vol. to 33% by vol. %, based on the total volume of said thermal barrier coating;

said thermal barrier coating includes a layer of said metal bond material applied directly to said combustion surface of said crown, said thermal barrier coating has a thickness extending from said combustion surface to an exposed surface, and 5% to 20% of said thickness of said thermal barrier coating consists of said layer of said metal bond material;

said thermal barrier coating includes said mixture applied directly to said layer of said metal bond material, 30% to 90% of said thickness of said thermal barrier coating consists of said mixture, the amount of said ceramic material present in said mixture increases continuously from said layer of said metal bond material toward said exposed surface;

said thermal barrier coating includes a layer of said ceramic material applied directly to said mixture and extending to said exposed surface, and 5% to 50% of said thickness of said thermal barrier coating consists of said layer of said ceramic material;

said thickness of said thermal barrier coating is not greater than 0.7 mm;

said thermal barrier coating has a specific heat of 480 J/kg·K to 610 J/kg·K at temperatures between 40 and 700° C.;

said thermal barrier coating applied to said combustion surface has a bond strength of at least 2000 psi when tested according to ASTM C633.

12. The piston of claim 1, wherein the thermal barrier coating has a thickness of not greater than 0.38 mm.

13. The piston of claim 1, wherein said exposed surface of said thermal barrier coating has a surface roughness Ra of less than 15 μm and a surface roughness Rz of not greater than ≤110 μm.

14. A piston, comprising:

a body portion formed of metal;

said body portion including a crown;

a thermal barrier coating applied to said crown;

said thermal barrier coating including a mixture of a metal bond material and a ceramic material;

said thermal barrier coating having a thermal conductivity of less than 0.5 W/m·K; and an outer layer formed of metal applied to said thermal barrier coating.

15. The piston of claim 14, wherein said outer layer includes nickel.

16. The piston of claim 14, wherein said outer layer has a thickness of 1 to 50 microns.

* * * * *